US009756971B2

(12) United States Patent
Salama

(10) Patent No.: US 9,756,971 B2
(45) Date of Patent: Sep. 12, 2017

(54) ADJUSTABLE BEVERAGE INSULATOR DEVICES

(71) Applicant: David John Salama, Cornelius, NC (US)

(72) Inventor: David John Salama, Cornelius, NC (US)

(73) Assignee: David John Salama, Cornelius, NC (US)

( * ) Notice: Subject to any disclaimer, the term of this patent is extended or adjusted under 35 U.S.C. 154(b) by 0 days.

(21) Appl. No.: 14/994,241

(22) Filed: Jan. 13, 2016

(65) Prior Publication Data

US 2016/0227948 A1 Aug. 11, 2016

Related U.S. Application Data

(60) Provisional application No. 62/176,067, filed on Feb. 9, 2015, provisional application No. 62/176,675, filed on Feb. 26, 2015.

(51) Int. Cl.
*A47G 23/02* (2006.01)
*B65D 81/38* (2006.01)

(52) U.S. Cl.
CPC ..... *A47G 23/0216* (2013.01); *B65D 81/3876* (2013.01); *A47G 2023/0283* (2013.01)

(58) Field of Classification Search
CPC ..... B65D 81/3876; A47G 2023/0283; A47G 2023/0275; A47G 23/0216
USPC ..... 220/903, 739
See application file for complete search history.

(56) References Cited

U.S. PATENT DOCUMENTS 5,071,096 A * 12/1991 Hartmann ..... A47G 23/0216 248/154

* cited by examiner

*Primary Examiner* — Stephen Castellano
(74) *Attorney, Agent, or Firm* — Clements Bernard Walker PLLC; Christopher L. Bernard

(57) ABSTRACT

An adjustable beverage insulator device, including: a side wall forming a substantially cylindrical vessel holding structure defining a slot along one side of the substantially cylindrical vessel holding structure, wherein the slot traverses the length of the substantially cylindrical vessel holding structure from a top portion to a bottom portion thereof; wherein a bottom portion of the substantially cylindrical vessel holding structure optionally includes one of a spring clamp and a constriction mechanism operable for biasing the substantially cylindrical vessel holding structure into a constricted configuration. The side wall includes one of a substantially rigid material and a substantially flexible material, and optionally an insulation material disposed one of on and adjacent to an interior or exterior surface thereof. Optionally, the slot is sized to accommodate the handle of a vessel selectively disposed within the substantially cylindrical vessel holding structure. Optionally, the adjustable beverage insulator further includes a floor structure coupled to the bottom portion of the substantially cylindrical vessel holding structure. Optionally, the floor structure has a variable diameter.

6 Claims, 13 Drawing Sheets

ADJUSTABLE BEVERAGE INSULATOR DEVICES

CROSS-REFERENCE TO RELATED APPLICATIONS

The present patent application/patent claims the benefit of priority of U.S. Provisional Patent Application No. 62/176,067, filed on Feb. 9, 2015, and entitled "MUG INSULATOR" and U.S. Provisional Patent Application No. 62/176,675, filed on Feb. 26, 2015, and entitled "MUG INSULATOR CONSTRICTOR SPRING," the contents of both of which are incorporated in full by reference herein.

FIELD OF THE INVENTION

The present invention relates generally to an adjustable beverage insulator. More specifically, the present invention relates to an adjustable beverage insulator that is configured to securely hold a substantially cylindrical cup, glass, mug with a handle, or the like.

BACKGROUND OF THE INVENTION

While it is quite commonplace to find a variety of beverage insulators that are configured to securely hold a substantially cylindrical cup or glass, such beverage insulators are typically not adequately adjustable and do not accommodate mugs with handles or the like. Mugs with handles are ubiquitous in most households and workplaces today. Most conventional adjustable beverage insulators are simply made of a resilient material, include one or more expansion slots or the like, and/or make no accommodation for the handle of a mug or the like, or include cumbersome straps that are designed to pass through or around the handle of a mug or the like. As a result, these conventional adjustable beverage insulators simply do not work very well and have limited utility. Thus, what is still needed in the art is an improved adjustable beverage insulator that is configured to securely hold a substantially cylindrical cup, glass, mug with a handle, or the like.

BRIEF SUMMARY OF THE INVENTION

In various exemplary embodiments, the present invention provides an improved adjustable beverage insulator that is configured to securely hold a substantially cylindrical cup, glass, mug with a handle, or the like. —keeping the contents thereof warm or cold. Advantageously, the adjustable beverage insulator is able to securely surround and retain various sized vessels, and allows the handle of a mug, for example, to protrude through, such that the mug can be grasped and held by the handle while the adjustable beverage insulator is in use. The adjustable beverage insulator utilizes a relatively simple design and is relatively inexpensive to manufacture from a variety of industry-standard materials.

In one exemplary embodiment, the present invention provides an adjustable beverage insulator device, including: a side wall forming a substantially cylindrical vessel holding structure defining a slot along one side of the substantially cylindrical vessel holding structure, wherein the slot traverses the length of the substantially cylindrical vessel holding structure from a top portion to at least a center portion thereof. Optionally, the slot traverses the length of the substantially cylindrical vessel holding structure from the top portion to a bottom portion thereof. Optionally, the bottom portion of the substantially cylindrical vessel holding structure includes a contiguous side wall. Optionally, the bottom portion of the substantially cylindrical vessel holding structure includes one of an integral or coupled spring clamp and a constriction mechanism operable for biasing the substantially cylindrical vessel holding structure into a constricted configuration. The side wall includes one of a substantially rigid material and a substantially flexible material. Optionally, the side wall includes an insulation material disposed one of on and adjacent to an interior surface thereof. The slot is sized to accommodate the handle of a vessel selectively disposed within the substantially cylindrical vessel holding structure. Optionally, the adjustable beverage insulator further includes a floor structure coupled to the bottom portion of the substantially cylindrical vessel holding structure. Optionally, the floor structure has a variable diameter.

In another exemplary embodiment, the present invention provides an adjustable beverage insulator device, including: a side wall forming a substantially cylindrical vessel holding structure defining a slot along one side of the substantially cylindrical vessel holding structure, wherein the slot traverses the length of the substantially cylindrical vessel holding structure from a top portion to a bottom portion thereof; wherein a bottom portion of the substantially cylindrical vessel holding structure includes one of an integral or coupled spring clamp and a constriction mechanism operable for biasing the substantially cylindrical vessel holding structure into a constricted configuration. Optionally, the one of the spring clamp and the constriction mechanism is coupled to the bottom portion of the substantially cylindrical vessel holding structure. Alternatively, the one of the spring clamp and the constriction mechanism is disposed concentrically about the bottom portion of the substantially cylindrical vessel holding structure. The side wall includes one of a substantially rigid material and a substantially flexible material. Optionally, the side wall includes an insulation material disposed one of on and adjacent to an interior surface thereof. The slot is sized to accommodate the handle of a vessel selectively disposed within the substantially cylindrical vessel holding structure. Optionally, the adjustable beverage insulator further includes a floor structure coupled to the bottom portion of the substantially cylindrical vessel holding structure. Optionally, the floor structure has a variable diameter.

In a further exemplary embodiment, the present invention provides an adjustable beverage insulator device, including: a side wall forming a substantially cylindrical vessel holding structure defining a slot along one side of the substantially cylindrical vessel holding structure, wherein the slot traverses the length of the substantially cylindrical vessel holding structure from a top portion to at least a center portion thereof. Optionally, the slot traverses the length of the substantially cylindrical vessel holding structure from the top portion to a bottom portion thereof. Optionally, the bottom portion of the substantially cylindrical vessel holding structure includes a contiguous side wall. Optionally, the bottom portion of the substantially cylindrical vessel holding structure includes one of an integral or coupled spring clamp and a constriction mechanism operable for biasing the substantially cylindrical vessel holding structure into a constricted configuration, which may also be self-biased into a constricted configuration The side wall includes one of a substantially rigid material and a substantially flexible material. Optionally, the side wall includes an insulation material disposed one of on and adjacent to an interior or exterior surface thereof. Optionally, the slot is sized to accommodate the handle of a vessel selectively disposed within the substantially cylindrical vessel holding structure. Optionally, the adjustable beverage insulator further includes a floor structure coupled to the bottom portion of the substantially cylindrical vessel holding structure. Optionally, the floor structure has a variable diameter. The adjustable beverage insulator may also use an outer insulating skin.

BRIEF DESCRIPTION OF THE DRAWINGS

The present invention is illustrated and described herein with reference to the various drawings, in which like reference numbers are used to denote like device components/method steps, as appropriate, and in which.

DETAILED DESCRIPTION OF THE INVENTION

Figure 1:
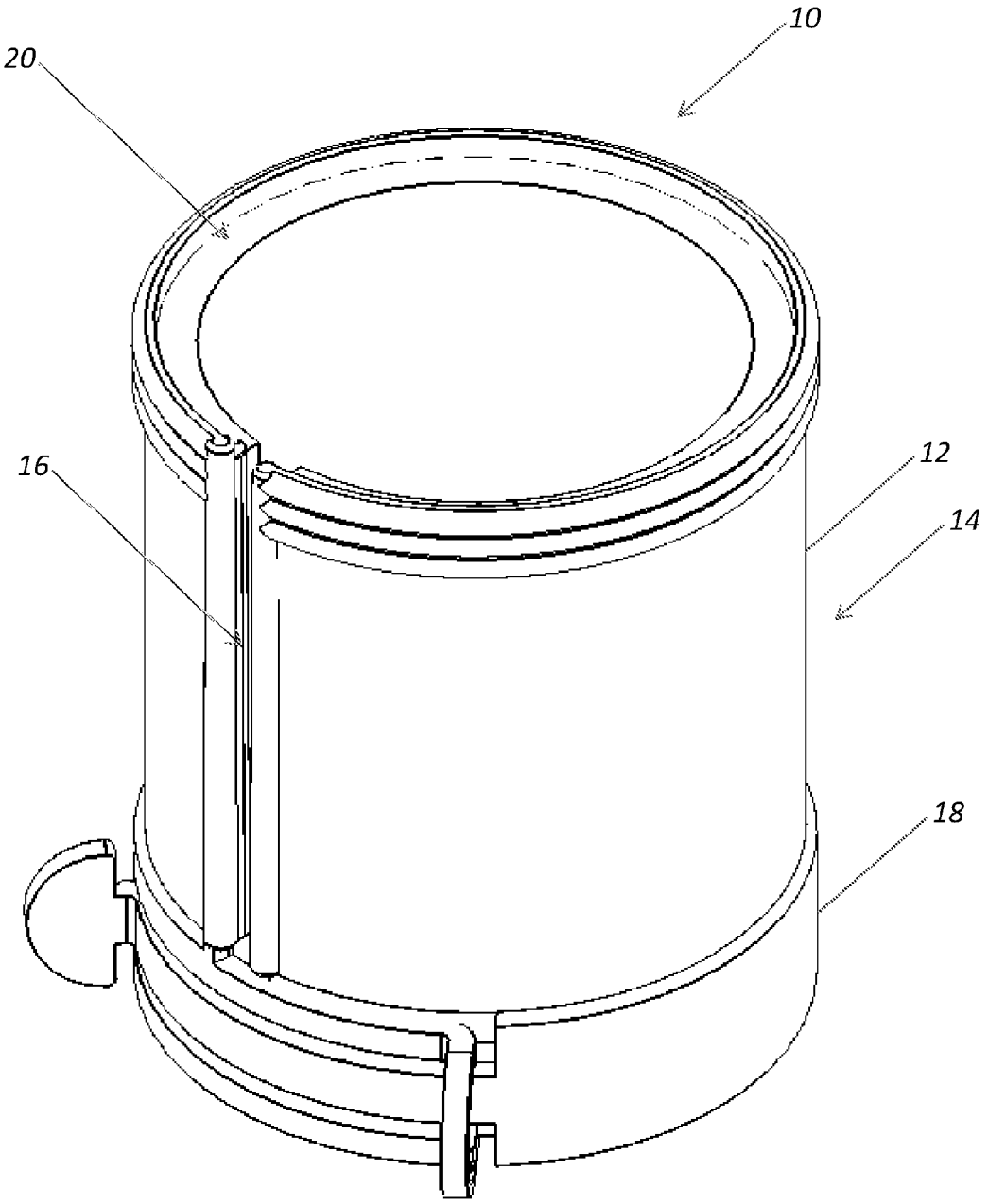
FIG. 1 is a perspective view of one exemplary embodiment of the adjustable beverage insulator of the present invention.
Figure 2:
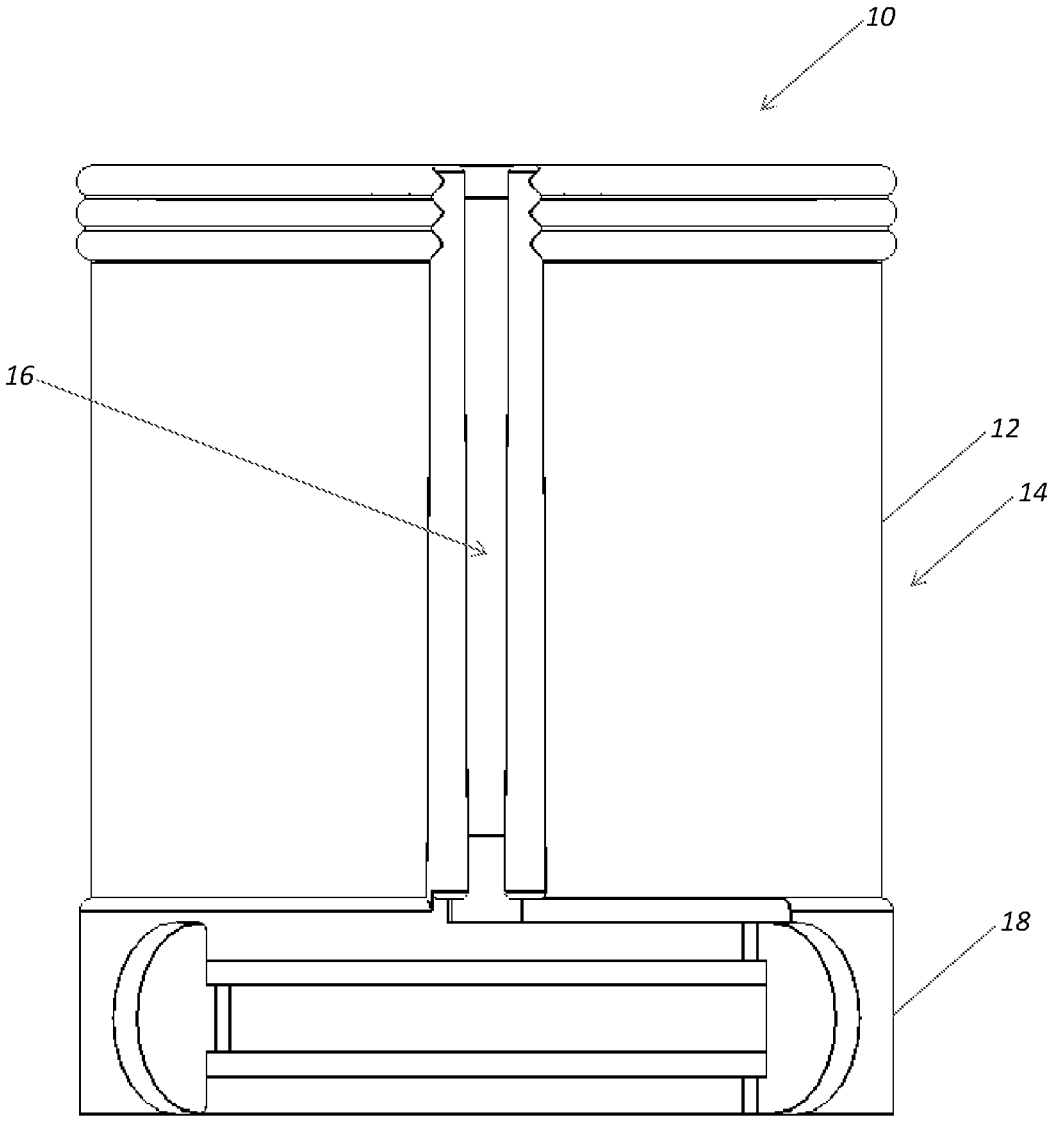
FIG. 2 is a front planar view of one exemplary embodiment of the adjustable beverage insulator of the present invention.
Figure 3:
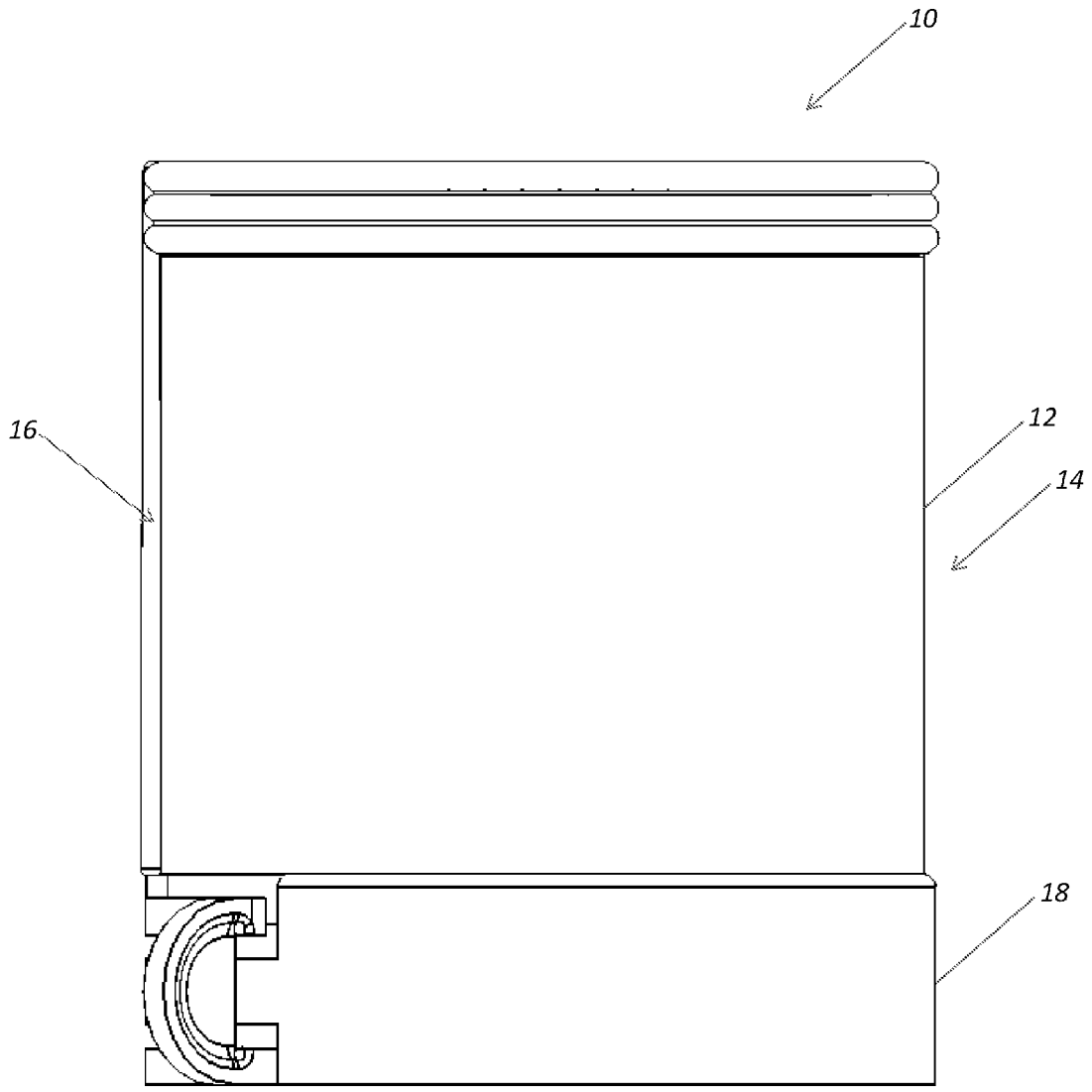
FIG. 3 is a side planar view of one exemplary embodiment of the adjustable beverage insulator of the present invention.
Figure 4:
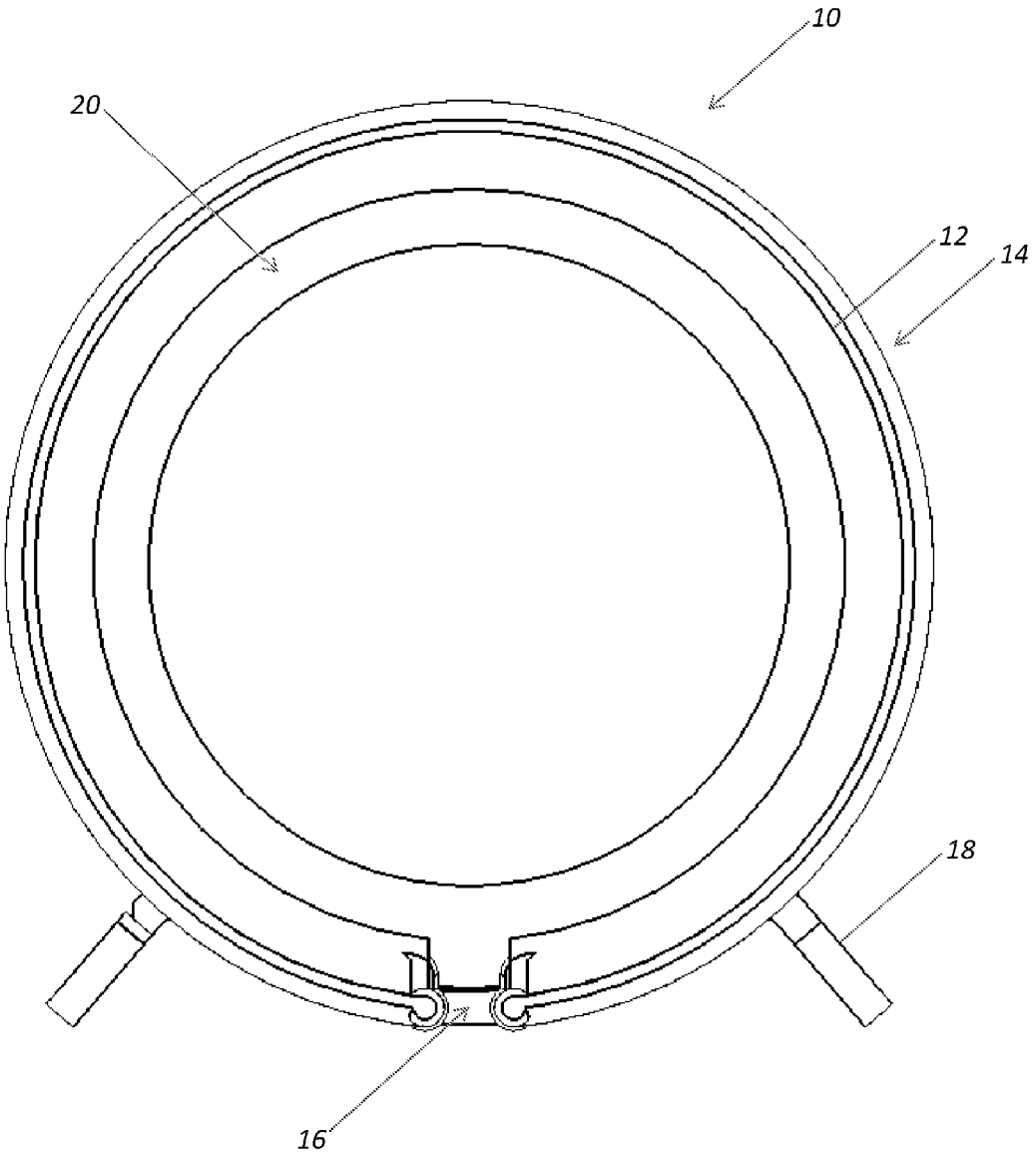
FIG. 4 is a top planar view of one exemplary embodiment of the adjustable beverage insulator of the present invention.

Referring now specifically to FIGS. 1-4, in one exemplary embodiment, the adjustable beverage insulator device 10 of the present invention includes a side wall 12 forming a substantially cylindrical vessel holding structure 14 defining a slot 16 along one side of the substantially cylindrical vessel holding structure 14. Specifically, the substantially cylindrical vessel holding structure 14 is configured to selectively hold and retain a substantially cylindrical cup, glass, mug with a handle, or the like, and insulate the same such that the beverage disposed inside stays warmer or colder longer. Similar simple beverage "cozies" or "koozies" are well known to those of ordinary skill in the art, but suffer from the shortcomings described above. In this exemplary embodiment, the slot 16 traverses the length of the substantially cylindrical vessel holding structure 14 from a top portion to a bottom portion thereof. This enables the side wall 12 to expand or contract to accommodate a variety of sizes of containers. Further, in this exemplary embodiment, a bottom portion of the substantially cylindrical vessel holding structure 14 includes one of a spring clamp 18 or similar constriction mechanism operable for biasing the substantially cylindrical vessel holding structure 14 into a constricted configuration about the container, regardless of its size.

The spring clamp 18 or similar constriction mechanism may be, for example, a conventional concentric band finger-operated spring clamp including interlaced portions with finger tabs that are pressed together and released to open and close the spring clamp. Such spring clamps are well know to those of ordinary skill in the art. The spring clamp 18 or similar constriction mechanism may be coupled to the bottom portion of the substantially cylindrical vessel holding structure 14 or may be disposed concentrically about the bottom portion of the substantially cylindrical vessel holding structure 14, provided that its actuation expands or contracts the side wall 12 to accommodate a variety of sizes of containers—each containers being securely held by the substantially cylindrical vessel holding structure 14.

The side wall 12 and/or other components of the adjustable beverage insulator device 10 may be manufactured from a substantially rigid material or a substantially flexible material, such as a metal material, a plastic material, a foam material, etc. All of the components may be integrally formed or formed separately and then coupled together. For example, the side wall 12 may be manufactured from a curved rigid or semi-rigid plastic material, and the spring clamp 18 may be manufactured from a curved rigid or semi-rigid metal or plastic material disposed about, coupled to, or integrally formed with the bottom portion of the side wall 12. Optionally, the side wall 12 includes a foam insulation material 20 disposed one of on and adjacent to an interior surface thereof, if the side wall material itself does not provide adequate insulation. Advantageously, this foam insulation material 20 helps to hold and retain the container disposed within the substantially cylindrical vessel holding structure 14.

Optionally, the slot 16 is sized to accommodate the handle of a mug selectively disposed within the substantially cylindrical vessel holding structure 14, such that the handle protrudes from the exterior surface of the side wall 12 and the substantially cylindrical vessel holding structure 14 and may be grasped by a user as if the adjustable beverage insulator device 10 is not present.

As an optional feature only, a top edge of the side wall 12 may include one or more raised or lowered portions forming a curvilinear top edge of the side wall 12 that provides access or "sipping" spots via which the user can gain access to the container disposed within and held by the substantially cylindrical vessel holding structure 14. The substantially cylindrical vessel holding structure 14 can also incorporate other circumferential or vertical frame members, ribs, lips, and/or panels that impart the substantially cylindrical vessel holding structure 14 with a desired degree of thickness, rigidity, flexibility, and/or deformability.

Figure 5:
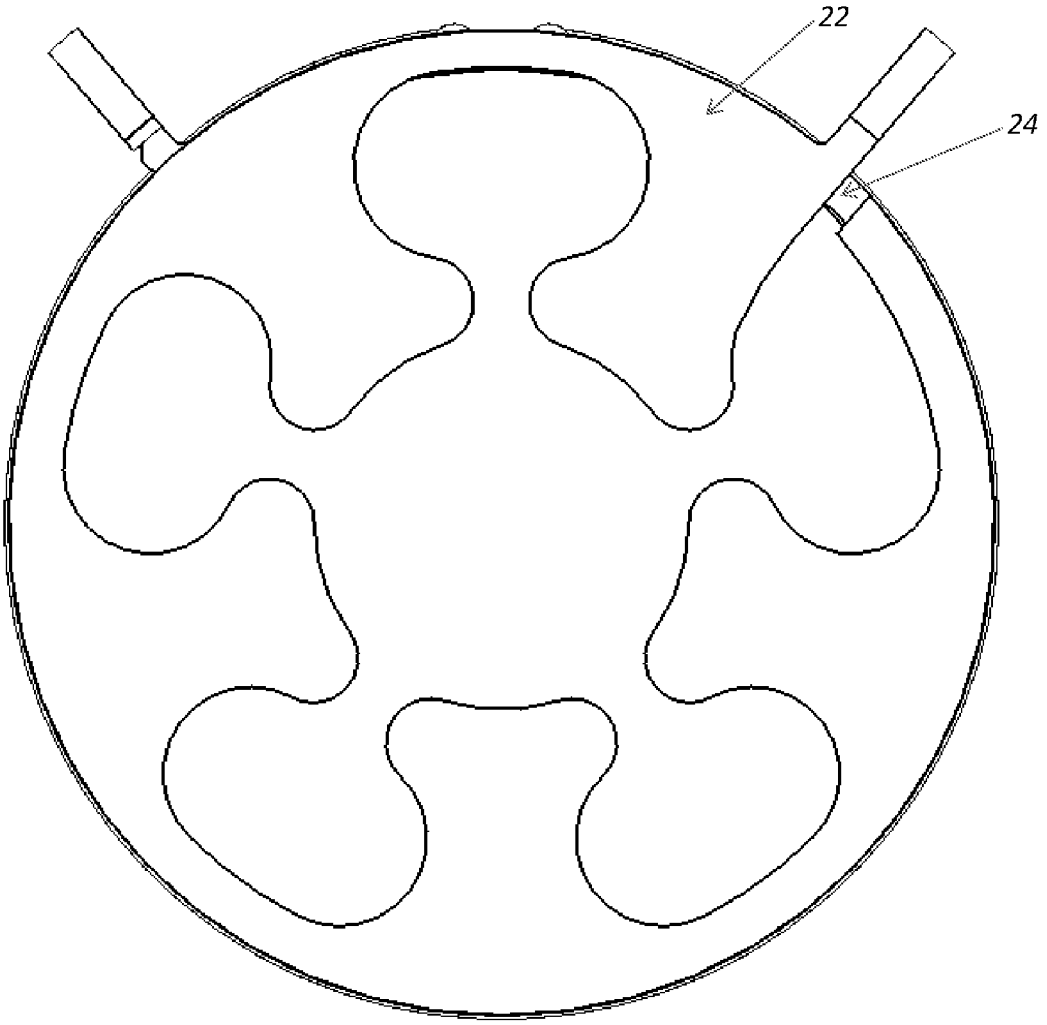
FIG. 5 is a bottom planar view of one exemplary embodiment of the adjustable beverage insulator of the present invention.
Figure 6:
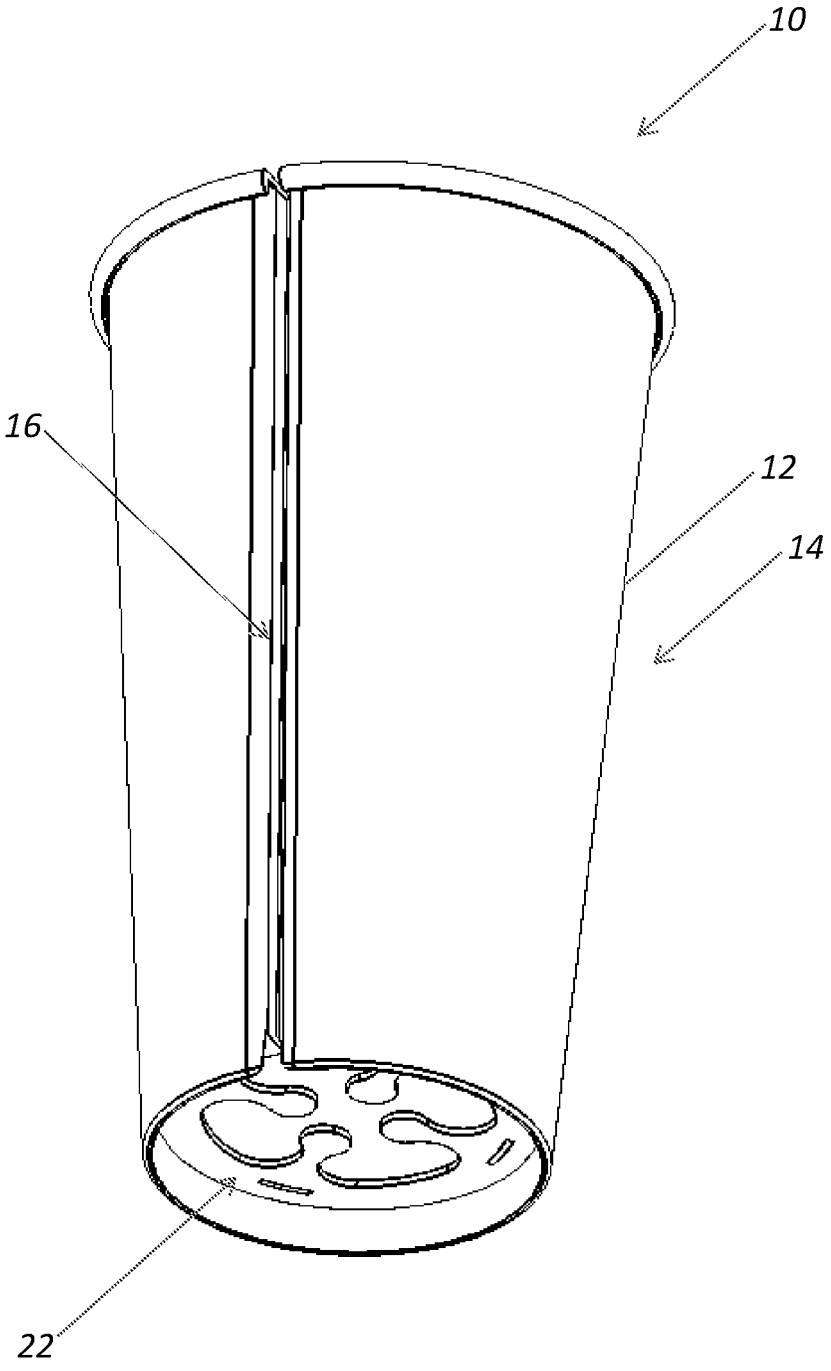
FIG. 6 is a perspective view of another exemplary embodiment of the adjustable beverage insulator of the present invention.
Figure 7:
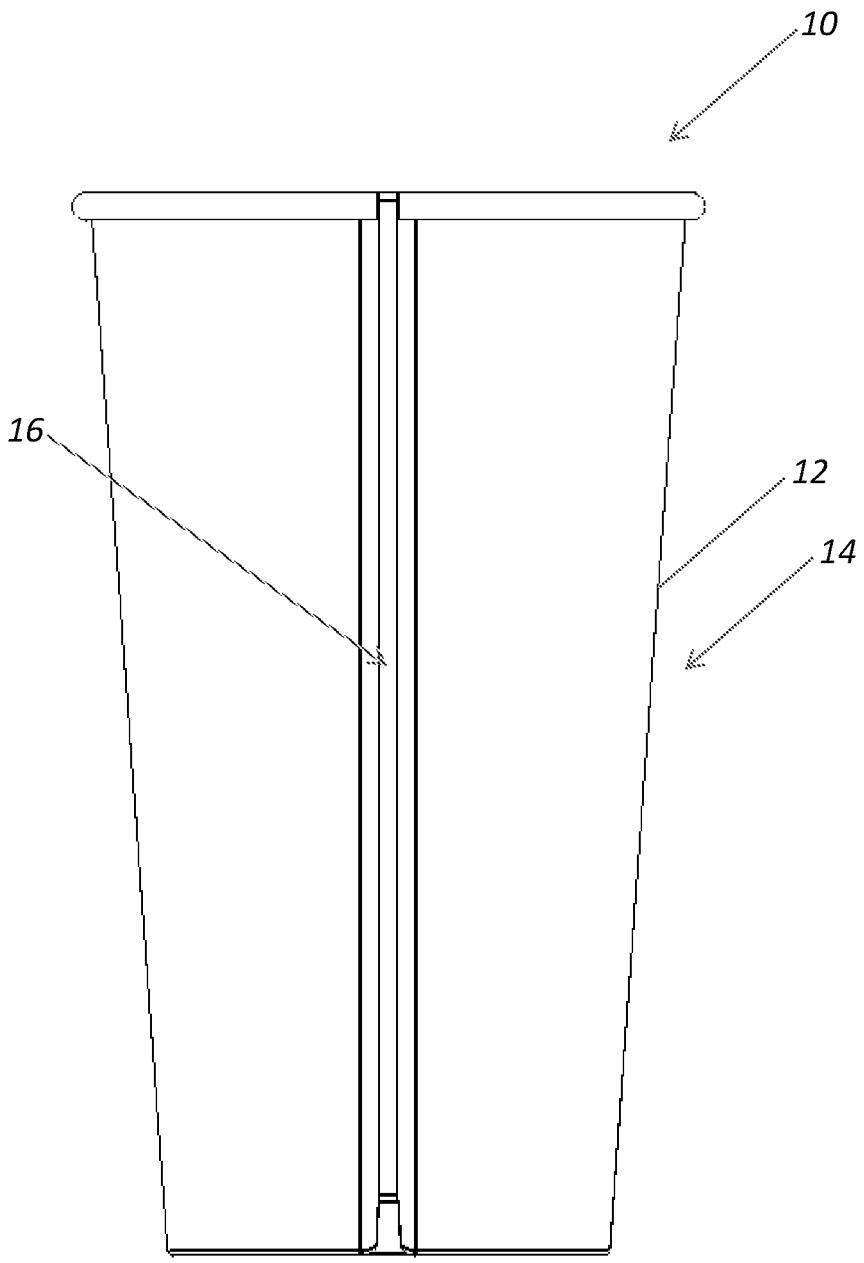
FIG. 7 is a front planar view of another exemplary embodiment of the adjustable beverage insulator of the present invention.
Figure 8:
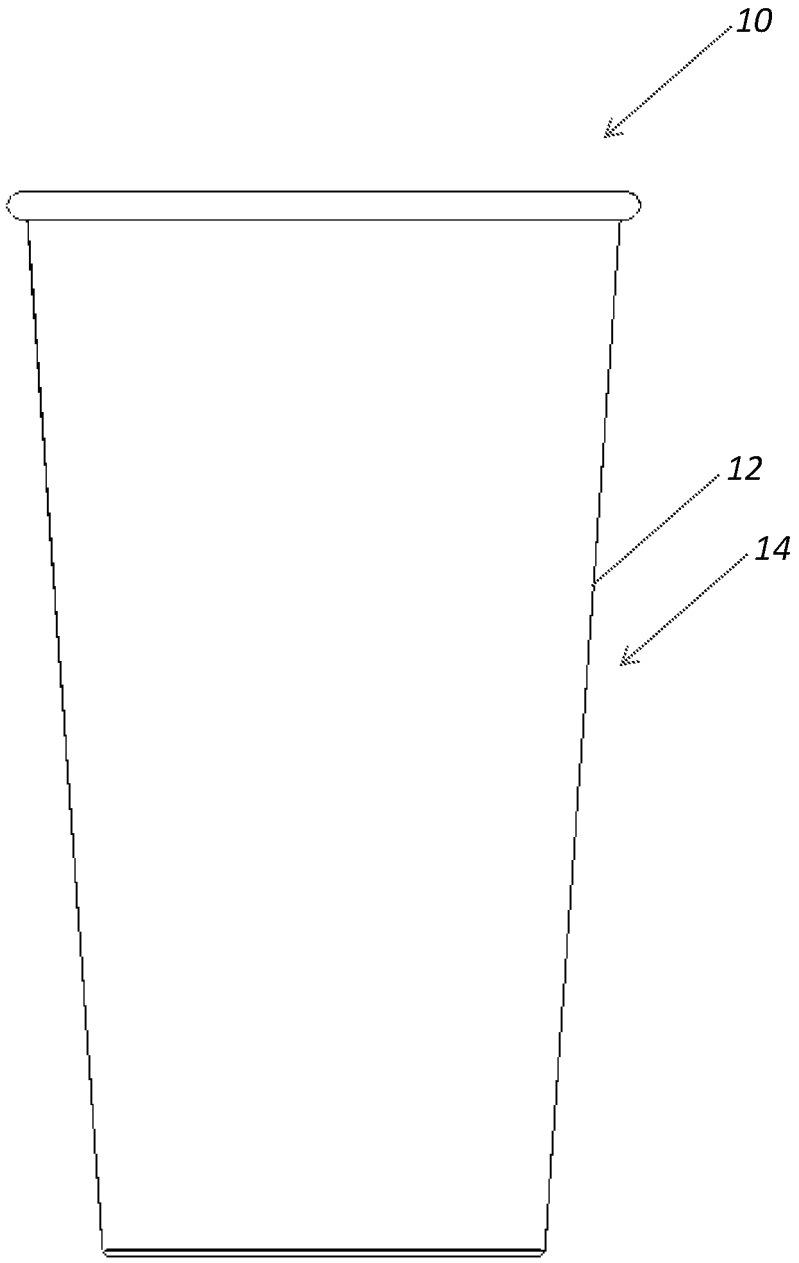
FIG. 8 is a side planar view of another exemplary embodiment of the adjustable beverage insulator of the present invention.
Figure 9:
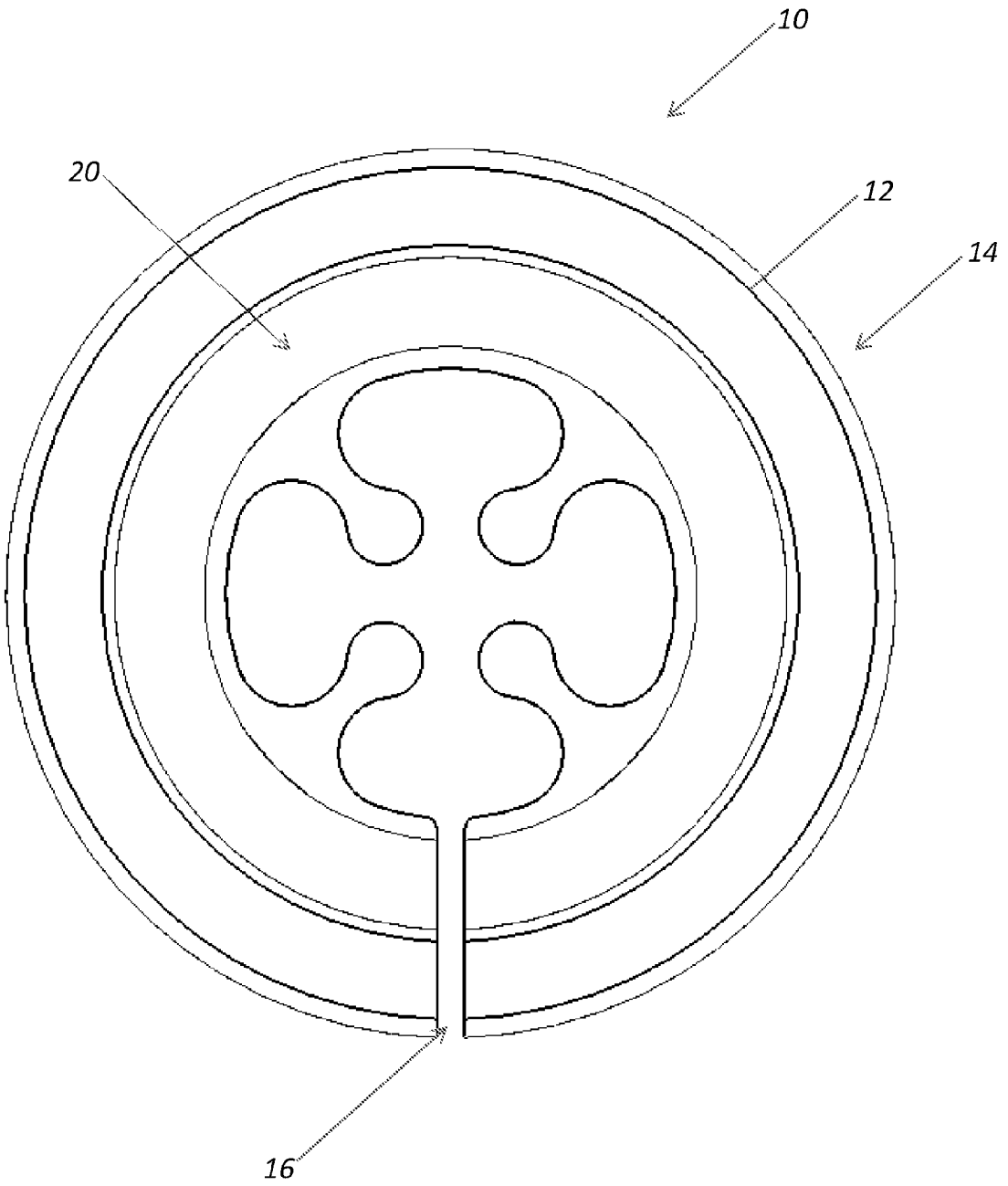
FIG. 9 is a top planar view of another exemplary embodiment of the adjustable beverage insulator of the present invention.

Referring now specifically to FIG. 5, in one exemplary embodiment, the adjustable beverage insulator device 10 of the present invention also includes a floor structure 22 coupled to the bottom portion of the substantially cylindrical vessel holding structure 14. The floor structure 22 may have a variable diameter, accommodating expansion/contraction of the side wall 12, via a slot 24 or the like manufactured into the floor structure. It will be readily apparent to those of ordinary skill in the art that other mechanisms could be used to implement this same functionality.

Referring now specifically to FIGS. 6-9, in another exemplary embodiment, the adjustable beverage insulator device 10 of the present invention again includes a side wall 12 forming a substantially cylindrical vessel holding structure 14 defining a slot 16 along one side of the substantially cylindrical vessel holding structure 14. Specifically, the substantially cylindrical vessel holding structure 14 is configured to selectively hold and retain a substantially cylindrical cup, glass, mug with a handle, or the like, and insulate the same such that the beverage disposed inside stays warmer or colder longer. Similar simple beverage "cozys" or "koozies" are well known to those of ordinary skill in the art, but suffer from the shortcomings described above. In this exemplary embodiment, the slot 16 traverses all or a portion of the length of the substantially cylindrical vessel holding structure 14 from a top portion to a center of bottom portion thereof. This enables the side wall 12 to expand or contract to accommodate a variety of sizes of containers.

The side wall 12 and/or other components of the adjustable beverage insulator device 10 may be manufactured from a substantially rigid material or a substantially flexible material, such as a metal material, a plastic material, a foam material, etc. All of the components may be integrally formed or formed separately and then coupled together. For example, the side wall 12 may be manufactured from a curved rigid or semi-rigid plastic material. Optionally, the side wall 12 includes a foam insulation material 20 disposed one of on and adjacent to an interior or exterior surface thereof, if the side wall material itself does not provide adequate insulation. Advantageously, this foam insulation material 20 may help to hold and retain the container disposed within the substantially cylindrical vessel holding structure 14. The side wall 12 may also consist of a double-walled structure with a void in between filled with air, foam, mylar, or another insulating material.

Optionally, the slot 16 is sized to accommodate the handle of a mug selectively disposed within the substantially cylindrical vessel holding structure 14, such that the handle protrudes from the exterior surface of the side wall 12 and the substantially cylindrical vessel holding structure 14 and may be grasped by a user as if the adjustable beverage insulator device 10 is not present.

Again, as an optional feature only, a top edge of the side wall 12 may include one or more raised or lowered portions forming a curvilinear top edge of the side wall 12 that provides access or "sipping" spots via which the user can gain access to the container disposed within and held by the substantially cylindrical vessel holding structure 14. The substantially cylindrical vessel holding structure 14 can also incorporate other circumferential or vertical frame members, ribs, lips, and/or panels that impart the substantially cylindrical vessel holding structure 14 with a desired degree of thickness, rigidity, flexibility, and/or deformability.

Figure 10:
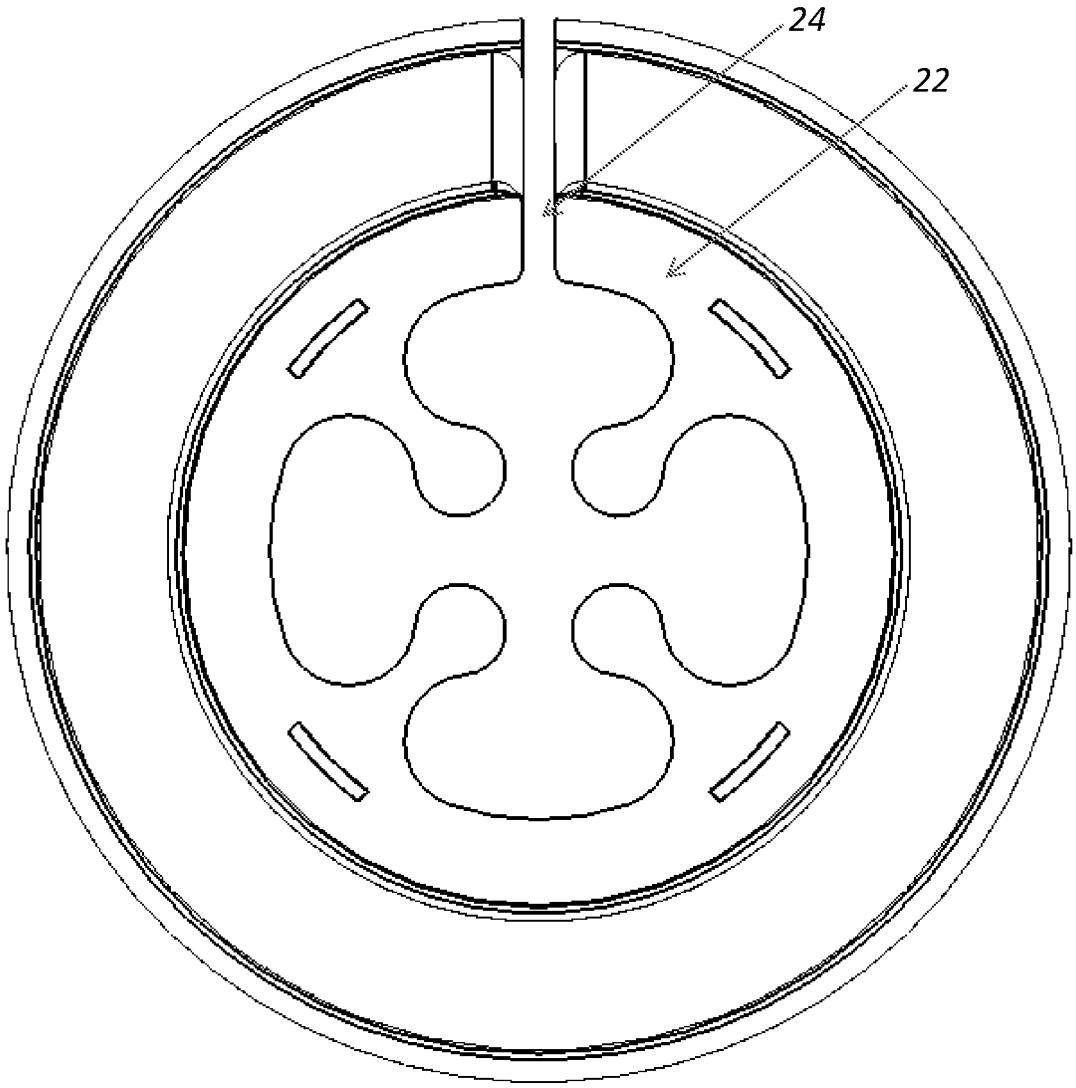
FIG. 10 is a bottom planar view of another exemplary embodiment of the adjustable beverage insulator of the present invention.

Referring now specifically to FIG. 10, in another exemplary embodiment, the adjustable beverage insulator device 10 of the present invention also includes a floor structure 22 coupled to the bottom portion of the substantially cylindrical vessel holding structure 14. The floor structure 22 may have a variable diameter, accommodating expansion/contraction of the side wall 12, via a slot 24 or the like manufactured into the floor structure. It will be readily apparent to those of ordinary skill in the art that other mechanisms could be used to implement this same functionality.

Figure 11:
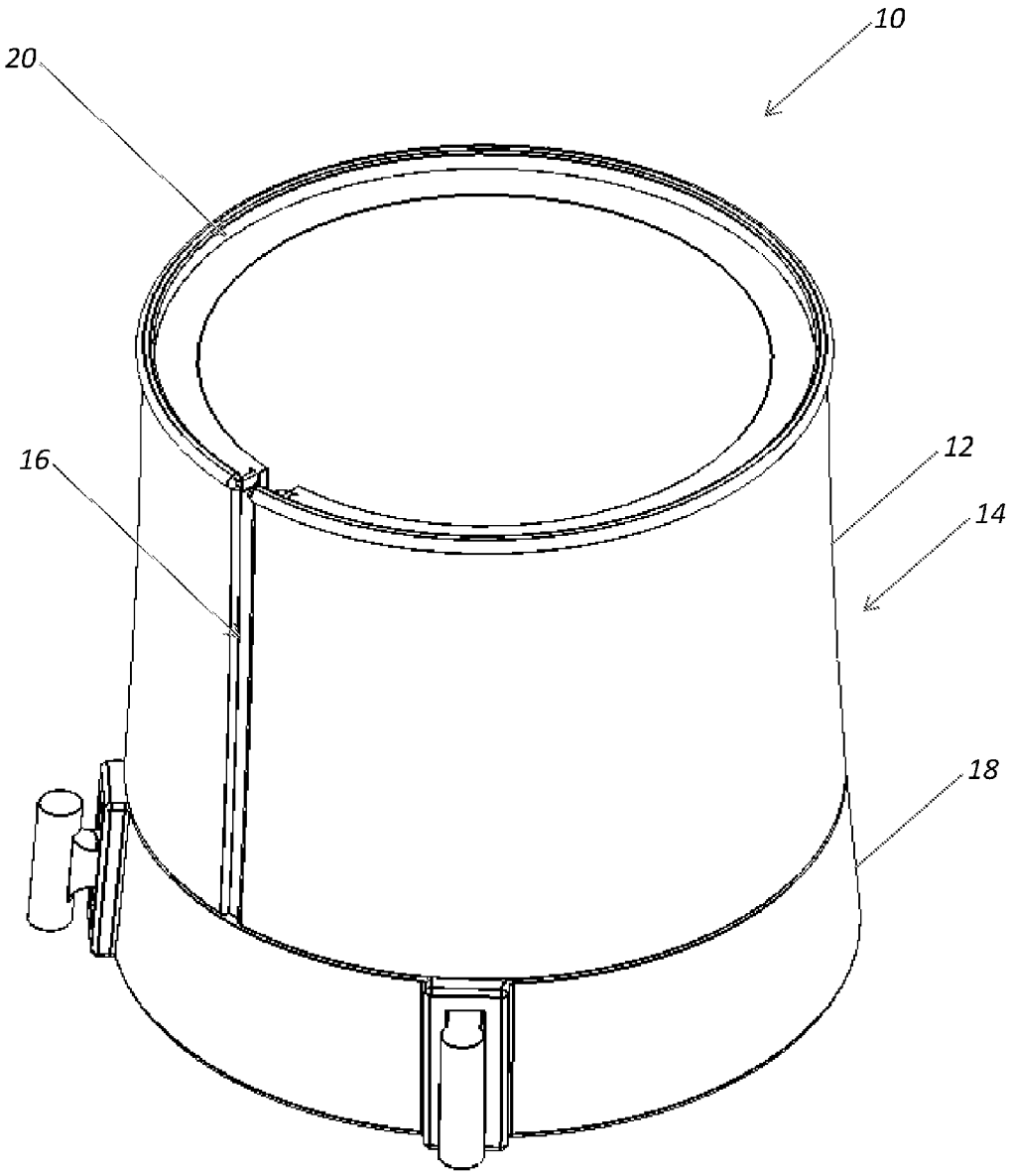
FIG. 11 is a perspective view of a further exemplary embodiment of the adjustable beverage insulator of the present invention.

Referring now specifically to FIG. 11, in a further exemplary embodiment, the adjustable beverage insulator device 10 of the present invention includes a side wall 12 forming a substantially cylindrical vessel holding structure 14 defining a slot 16 along one side of the substantially cylindrical vessel holding structure 14. Specifically, the substantially cylindrical vessel holding structure 14 is configured to selectively hold and retain a substantially cylindrical cup, glass, mug with a handle, or the like, and insulate the same such that the beverage disposed inside stays warmer or colder longer. Similar simple beverage "cozies" or "koozies" are well known to those of ordinary skill in the art, but suffer from the shortcomings described above. In this exemplary embodiment, the slot 16 traverses the length of the substantially cylindrical vessel holding structure 14 from a top portion to a bottom portion thereof. This enables the side wall 12 to expand or contract to accommodate a variety of sizes of containers. Further, in this exemplary embodiment, a bottom portion of the substantially cylindrical vessel holding structure 14 includes one of an integral spring clamp 18 or similar constriction mechanism operable for biasing the substantially cylindrical vessel holding structure 14 into a constricted configuration about the container, regardless of its size.

The integral spring clamp 18 or similar constriction mechanism may be, for example, a conventional concentric band finger-operated spring clamp including interlaced portions with finger tabs that are pressed together and released to open and close the spring clamp. Such spring clamps are well know to those of ordinary skill in the art. The spring clamp 18 or similar constriction mechanism may be coupled to the bottom portion of the substantially cylindrical vessel holding structure 14 or may be disposed concentrically about the bottom portion of the substantially cylindrical vessel holding structure 14, provided that its actuation expands or contracts the side wall 12 to accommodate a variety of sizes of containers—each containers being securely held by the substantially cylindrical vessel holding structure 14.

The side wall 12 and/or other components of the adjustable beverage insulator device 10 may be manufactured from a substantially rigid material or a substantially flexible material, such as a metal material, a plastic material, a foam material, etc. All of the components may be integrally formed or formed separately and then coupled together. For example, the side wall 12 may be manufactured from a curved rigid or semi-rigid plastic material, and the spring clamp 18 may be manufactured from a curved rigid or semi-rigid metal or plastic material disposed about, coupled to, or integrally formed with the bottom portion of the side wall 12. Optionally, the side wall 12 includes a foam insulation material 20 disposed one of on and adjacent to an interior or exterior surface thereof, if the side wall material itself does not provide adequate insulation. Advantageously, this foam insulation material 20 may help to hold and retain the container disposed within the substantially cylindrical vessel holding structure 14. The side wall 12 may also consist of a double-walled structure with a void in between filled with air, foam, mylar, or another insulating material.

Optionally, the slot 16 is sized to accommodate the handle of a mug selectively disposed within the substantially cylindrical vessel holding structure 14, such that the handle protrudes from the exterior surface of the side wall 12 and the substantially cylindrical vessel holding structure 14 and may be grasped by a user as if the adjustable beverage insulator device 10 is not present.

The substantially cylindrical vessel holding structure 14 can also incorporate other circumferential or vertical frame members, ribs, lips, and/or panels that impart the substantially cylindrical vessel holding structure 14 with a desired degree of thickness, rigidity, flexibility, and/or deformability.

Optionally, the adjustable beverage insulator device 10 of the present invention also includes a floor structure coupled to the bottom portion of the substantially cylindrical vessel holding structure. The floor structure may have a variable diameter, accommodating expansion/contraction of the side wall 12, via a slot or the like manufactured into the floor structure. It will be readily apparent to those of ordinary skill in the art that other mechanisms could be used to implement this same functionality.

Figure 12:
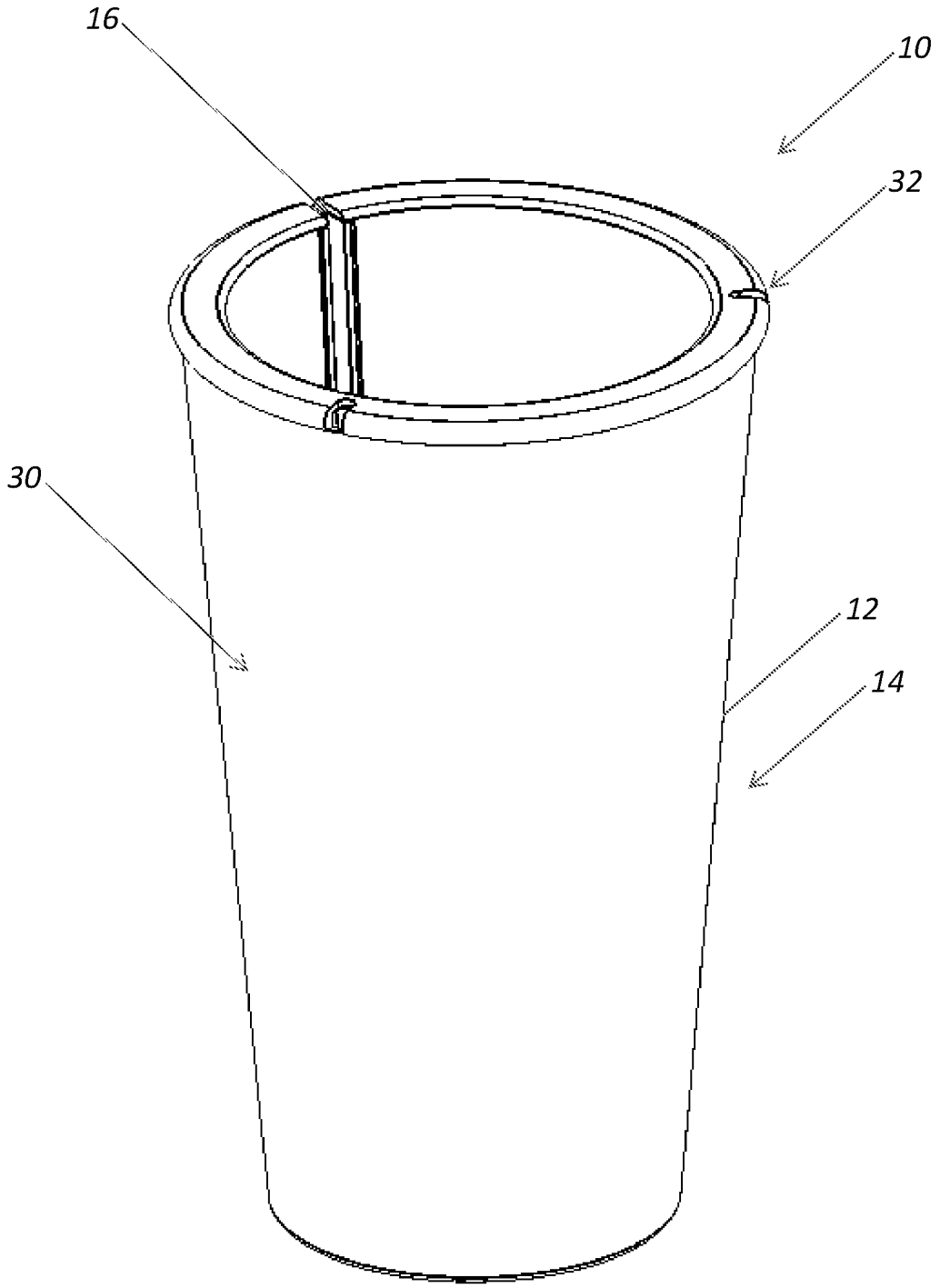
FIG. 12 is a perspective view of a still further exemplary embodiment of the adjustable beverage insulator of the present invention.

Referring now specifically to FIG. 12, in a still further exemplary embodiment, the adjustable beverage insulator device 10 of the present invention again includes a side wall 12 forming a substantially cylindrical vessel holding structure 14 defining a slot 16 along one side of the substantially cylindrical vessel holding structure 14. Specifically, the substantially cylindrical vessel holding structure 14 is configured to selectively hold and retain a substantially cylindrical cup, glass, mug with a handle, or the like, and insulate the same such that the beverage disposed inside stays warmer or colder longer. Similar simple beverage "cozys" or "koozies" are well known to those of ordinary skill in the art, but suffer from the shortcomings described above. In this exemplary embodiment, the slot 16 traverses all or a portion of the length of the substantially cylindrical vessel holding structure 14 from a top portion to a center of bottom portion thereof. This enables the side wall 12 to expand or contract to accommodate a variety of sizes of containers. The side wall 12 may also include one or more relief slots 32 at one or both ends that allow the side wall 12 flex more effectively with minimal deformity.

The side wall 12 and/or other components of the adjustable beverage insulator device 10 may be manufactured from a substantially rigid material or a substantially flexible material, such as a metal material, a plastic material, a foam material, etc. All of the components may be integrally formed or formed separately and then coupled together. For example, the side wall 12 may be manufactured from a curved rigid or semi-rigid plastic material. Optionally, the side wall 12 includes a foam insulation material 20 disposed one of on and adjacent to an interior or exterior surface thereof, if the side wall material itself does not provide adequate insulation. Advantageously, this foam insulation material 20 may help to hold and retain the container disposed within the substantially cylindrical vessel holding structure 14. The side wall 12 may also consist of a double-walled structure with a void in between filled with air, foam, mylar, or another insulating material.

Optionally, the adjustable beverage insulator device 10 of the present invention also includes a floor structure coupled to the bottom portion of the substantially cylindrical vessel holding structure. The floor structure may have a variable diameter, accommodating expansion/contraction of the side wall 12, via a slot or the like manufactured into the floor structure. It will be readily apparent to those of ordinary skill in the art that other mechanisms could be used to implement this same functionality.

Figure 13:
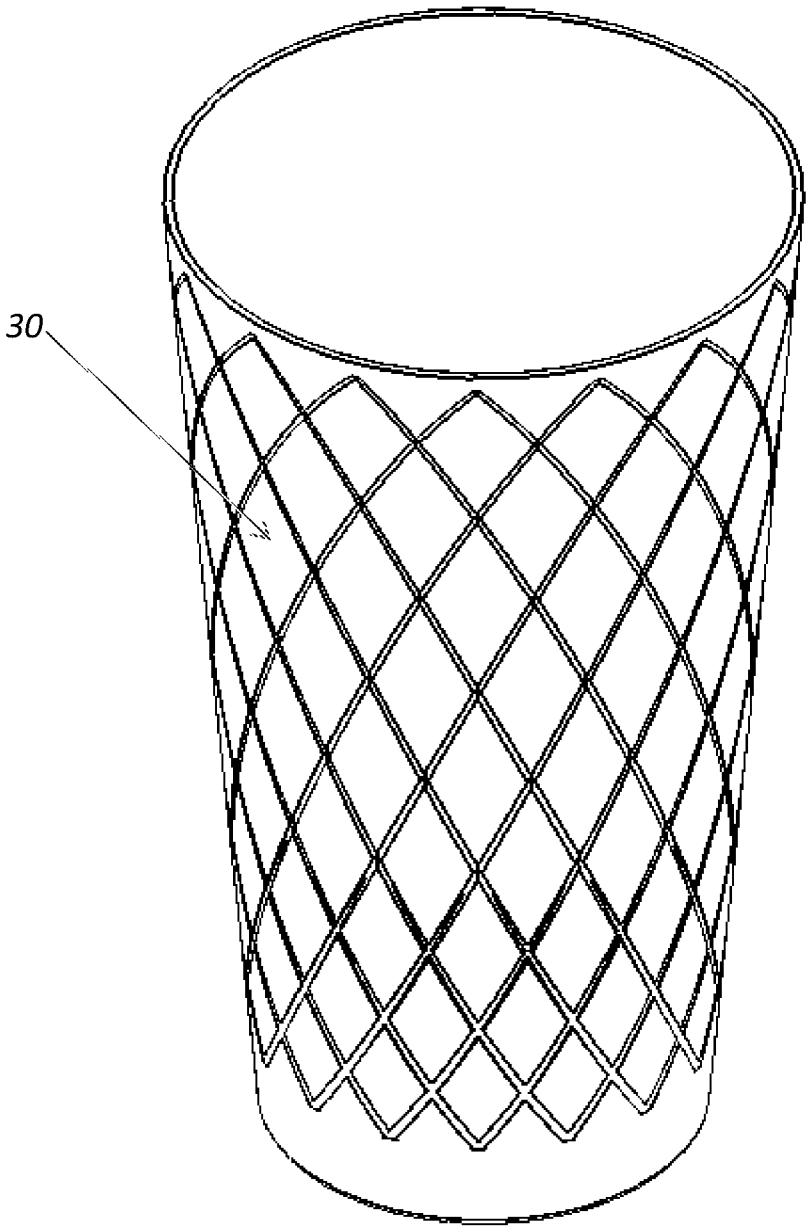
FIG. 13 is a perspective view of one exemplary embodiment of an outer insulating skin for use with various of the adjustable beverage insulators of the present invention.

FIG. 13 illustrates one exemplary embodiment of an outer insulating skin 30 for use with various of the adjustable beverage insulators 10 of the present invention. Optionally, this skin 30 may be elastic and assisting in the closure/grasping of the insulating device 10 on the beverage vessel. As illustrated in FIG. 11, the constricting elastic band 18 or the like may cover only a portion of the insulating device 10 to assist in the closure/grasping of the insulating device 10 on the beverage vessel.

Although the present invention is illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following non-limiting claims.

What is claimed is:

1. An adjustable beverage insulator device, comprising:

a side wall forming a substantially cylindrical vessel holding structure defining a slot along one side of the substantially cylindrical vessel holding structure, wherein the slot traverses the length of the substantially cylindrical vessel holding structure from a top portion to a bottom portion thereof;

wherein the bottom portion of the substantially cylindrical vessel holding structure comprises one of a spring clamp and a constriction mechanism operable for biasing the substantially cylindrical vessel holding structure into a constricted configuration; and wherein the one of the spring clamp and the constriction mechanism comprises a plurality of finger tabs that are pressed together and released to bias the substantially cylindrical vessel holding structure into the constricted configuration.

2. The adjustable beverage insulator device of claim 1, wherein the side wall comprises one of a substantially rigid material and a substantially flexible material.

3. The adjustable beverage insulator device of claim 1, wherein the side wall comprises an insulation material disposed one of on and adjacent to an interior or exterior surface thereof.

4. The adjustable beverage insulator device of claim 1, wherein the slot is sized to accommodate the handle of a vessel selectively disposed within the substantially cylindrical vessel holding structure.

5. The adjustable beverage insulator device of claim 1, further comprising a floor structure coupled to a bottom portion of the substantially cylindrical vessel holding structure.

6. The adjustable beverage insulator device of claim 5, wherein the floor structure has a variable diameter.

* * * * *